US006151764A

United States Patent [19]

Ebbinghaus

[11] Patent Number: 6,151,764

[45] Date of Patent: Nov. 28, 2000

[54] APPARATUS FOR THE SINGEING OF THREADS

[75] Inventor: Rainer Ebbinghaus, Mönchengladbach, Germany

[73] Assignee: Osthoff-Senge GmbH & Co. KG, Wuppertal, Germany

[21] Appl. No.: 09/220,638

[22] Filed: Dec. 24, 1998

[51] Int. Cl.[7] ..... D02J 3/16

[52] U.S. Cl. ..... 28/174; 28/239

[58] Field of Search ..... 26/3, 4, 5, 6; 28/239, 28/174

[56] References Cited

U.S. PATENT DOCUMENTS

| | | | |
|---|---|---|---|
| 1,768,662 | 7/1930 | Buckley | 28/174 |
| 1,988,554 | 1/1935 | Hall | 26/3 |
| 3,421,746 | 1/1969 | McCoy | 26/3 |
| 3,448,498 | 6/1969 | Sando et al. | 26/3 |
| 3,524,233 | 8/1970 | Vorderbrugge | 26/3 |
| 4,627,135 | 12/1986 | Osthoff | 26/3 |
| 4,641,403 | 2/1987 | Osthoff et al. | 26/3 |
| 4,774,747 | 10/1988 | Kurschatke | 26/3 |
| 5,745,966 | 5/1998 | Osthoff et al. | 26/3 |

FOREIGN PATENT DOCUMENTS

| | | | |
|---|---|---|---|
| 29505376 | 9/1996 | Germany . | |
| 454417 | 2/1970 | Japan | 26/3 |

*Primary Examiner*—Amy B. Vanatta
*Attorney, Agent, or Firm*—Martin A. Farber

[57] ABSTRACT

An apparatus (V) for the singeing of threads (1), preferably of a thread assembly, for example for use in the manufacture of a carpet, the thread assembly comprising twisted threads of a plastic material, such as nylon (polyamides), polyester and the like. The apparatus (V) comprises a heat section, and a burner (5) which produces a singeing flame (7). The threads (1) run, upstream and/or downstream of the singeing flame (7), through the heat section (18), the heat section being formed independently of the burner (5) and being set at a temperature influencing the macromolecular structure of the plastic material.

33 Claims, 5 Drawing Sheets

16
13
x
1
1
12
17
11
31
1'
31
25
2
30
30
32
z
y
32
3
32
32
18
19
19
V
21
20
21
29
5
28
4
28
8
26
29
7
26
7
27
5
9
8
9
27
6
6
10
10
14
1''
24
23
15
x

APPARATUS FOR THE SINGEING OF THREADS

FIELD AND BACKGROUND OF THE INVENTION

The invention relates to an apparatus for the singeing of threads, preferably of a thread assembly, for example for use in the manufacture of a carpet, the thread assembly consisting of twisted threads made of a plastic material, such as nylon (polyamides), polyester and the like, said apparatus having a burner which produces a singeing flame.

Singeing, adopted for preference over possible shearing, has acquired a wide field of use and given rise to the most diverse kinds of apparatus for eliminating the thread ends projecting from the thread core or from the fabric already made. In particular, if cloth is not cleaned or finished in this way, the run of the thread or cloth may be impaired considerably in the area of further processing, and in this respect, apart from a few exceptions, smoothed material, primarily warp threads, are preferred. Reference may be made, by way of example, to U.S. Pat. No. 1,988,554 and U.S. Pat. No. 1,768,662 for such singeing apparatus or singeing machines.

SUMMARY OF THE INVENTION

It is an object of the invention is to design a generic apparatus of the above-mentioned type in which the twisted threads are given a strong return action, in addition to the singeing treatment, and without any loss of elasticity, and also to improve the threads in dyeing terms.

This object is achieved according to the invention first, and essentially, in an apparatus wherein it is insured that the threads run, upstream and/or downstream of the singeing flame, through a heat section which is constructed independently of the burner and which is set at a temperature influencing the macromolecular structure of the plastic material. This results in form fixing or heat setting of the fibers of the threads. The twisted structure of these is, as it were, thermoset. The elasticity of the thread is nevertheless preserved. Such threads can advantageously be used, above all, in carpet manufacture. The return force of the pile or loop naps formed from such threads is increased. In addition to this, there is the effect of markedly improved affinity to the absorption of dyestuff. The fiber sheath is broken open to a greater extent than in the case of a thread not exposed to heat setting. An apparatus which operates particularly efficiently is obtained when the heat section acts on the threads by utilizing the energy of the singeing flame. Specifically, this heat source alone is sufficient as a heat supplier which is present in any case. As regards location and in structural terms, it proves advantageous for the heat section to consist of a platelike heatable body extending in the direction of the threads. Such a guide plate provides orientation for the heat flow. The heatability of the body also allows radiating heat to be utilized. A kind of chimney is achieved if two platelike bodies are arranged opposite one another so as to form a gap. The gap is dimensioned in such a way that the heat flow resulting from the singeing flame thoroughly "washes round" the cloth which is guided freely between the platelike bodies. Guide rollers make it possible to ensure that the threads run past a plate-like body without touching it. Contactless singeing/thermosetting is achieved. It is advantageous if the plate-like body consists of ceramic material. For example, marinite may be used here. It is then preferable for the flame of the singeing burner to strike that surface of the heatable body which faces the threads.

Reflecting effects can be utilized correspondingly, here, by utilizing the reflection surfaces of the bodies. Furthermore, the apparatus is defined by burners arranged on both sides of the cloth run. So-called double-jet burners are preferred. Such high-performance burners have proved outstanding in terms of the singeing quality achieved. The burners can be oriented independently of one another and are or can be also offset in terms of height. The corresponding local variation also applies to the means which define the burning point, this being achieved in that the heatable body is adjustable in the direction of the run of the threads and is lockable. This applies to both of the customary directions, in that the heatable body is also adjustable in the transverse direction to the run of the threads. Thus, the gap can be widened or narrowed even in overlapping movements and the heat section can be arranged at different distances from the source feeding it. Alternatively, treatment of the kind in question can also be varied or finely set in terms of the time factor, specifically over the length of the bodies and the speed of action. It is preferred, furthermore, that the threads be guided twice through the same heat section. In concrete terms, the procedure for this purpose is such that the threads pass through the heat section both in the direction running toward the burner and in the direction running back from the burner. This corresponds, in terms of singeing, to pretreatment and aftertreatment of the threads. There is also provision, or it may be useful, for the threads to be guided several times (more than twice) through the heat section. In order to allow fine adjustments of the heat flow washing round, there is provision, furthermore, for the threads running to and running back to be racked relative to one another, transversely to the thread assembly plane, in the region of the heat section. This is further optimized in that the threads running to and running back are racked relative to one another, in the thread assembly plane, in the region of the heat section.

On an apparatus of the introductory-mentioned type, on which, furthermore, the burner has a rail block forming a singeing slot, it is advantageous if the rail block has, in the working position of the burner, a surface which faces the threads and which forms an acute angle with the singeing slot. This has a directional effect on the heat flow. In this case, the rail block has a triangular contour lying transversely to the plane of the thread assembly. A measure which also influences the direction of the heat flow is then to arrange a suction chamber with an offtake fan upstream of the heat section in the run-to direction of the threads. By means of the air draft of the offtake fan, at least a large proportion of the singeing flame or heat flow is sucked into the region of the heat section. At the same time, in one development, the suction chamber facing away from the heat section is provided with bottom walls diverging in this direction. These, forming a V-pit, may immediately adjoin the heads of the plate-like bodies. The bottom walls have air inlet slots. A secondary flow enters via such inlets. The heat flow thus dwells in the gap for longer. To achieve the guidance of the thread assembly in the opposite direction, the invention provided a deflecting roller, as a guide roller, downstream of the burner in the run-to direction of the threads. Furthermore, in one embodiment, which even has independent significance, the deflecting roller is designed as an introduction aid bringing the thread to the appropriate location. Via such a threading-in device, the thread can, as it were, be drawn abruptly into the region of treatment. In this case, the structural means are such that the deflecting roller is mounted on the free end of a lifting arrangement displacing said deflecting roller vertically and can be lowered, and raised again, from a thread receiving point located near a feed and removal point into the singeing/thermosetting operating position. In this case, the feed and removal points are formed by upper guide rollers. The deflecting roller forms the reversal point of the run of the threads in opposite directions. In order to achieve the thread order emphasized above, a racking comb is arranged downstream of the deflecting roller. In an advantageous variant, the deflecting roller has guide grooves. Irrespective of the racking effect capable of being achieved thereby, it is then advantageous if the deflecting roller consists of a plurality of individual rollers. In this case, with regard to the introduction aid mentioned, it is advantageous if each individual roller of the deflecting roller is actuable via a separately acting lifting arrangement. This affords advantages for smooth running and with regard to the treatment of a smaller thread assembly or even of individual threads. With regard to the running of the cloth, that is to say of the threads, an advantageous embodiment also involves the own drive of at least part of the rollers determining the thread running direction, such as guide rollers or the deflecting roller.

The method for the singeing of threads, preferably of a threaded assembly, such as, for example, a warp thread assembly, for example for use in the manufacture of a carpet, the thread assembly consisting of twisted threads made of a plastic material, such as nylon (polyamides), polyester and the like, said apparatus having a burner which produces a singeing flame, is defined in that, in addition to singeing within the singeing apparatus, molecular action is taken on the thread by means of a heat section during said singeing. At the same time, the procedure is such that the threads pass through the singeing flame and the heat section at a speed of 500 to 1500 m/min. In this case, the temperature of the singeing flame is approximately 1200° C. and that of the heat section 400–500° C., depending on the material.

BRIEF DESCRIPTION OF THE DRAWINGS

With the above and other objects and other advantages in view, the present invention will become more clearly understood in connection with the detailed description of the preferred embodiment, when considered with the accompanying drawings of which.

DETAILED DESCRIPTION OF THE PREFERRED EMBODIMENT

Figure 1:
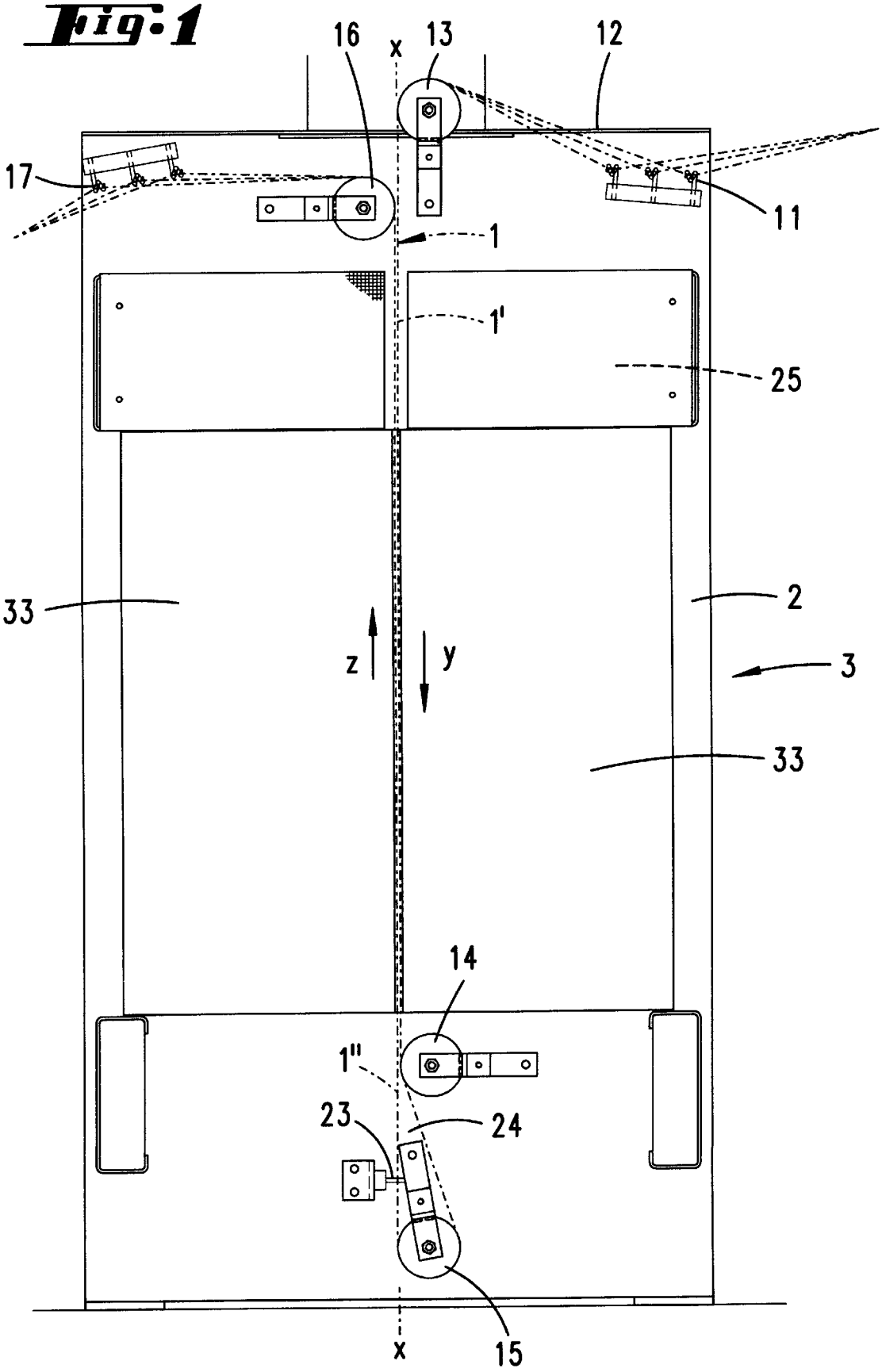
FIG. 1 shows a front view of the singeing apparatus, with the door closed.

The illustrated apparatus V for the singeing of threads 1, mainly a thread assembly, such as, for example, a warp thread assembly, is located in a machine housing 2 of a singeing machine 3. The latter is illustrated and described in German Utility Model 295 05 376. The disclosed content of this publication is herewith incorporated herein by reference in its entirety.

The thread 1 to be singed is a twisted thread. This consists of fibers. The basic material is plastic, such as, for example, nylon (polyamides), polyester and the like. The fiber ends projecting from the thread core are singed in a burning zone 4 of the apparatus V. Burners 5 arranged in pairs serve this purpose .

Each burner 5 is rotatable about a horizontal pivot axis 6 between a cutoff position and a working position.

In the region of treatment, the thread 1, or the thread assembly formed from this, assumes an essentially vertically oriented cloth run. The adjustable burners 5 are located on both sides of a correspondingly vertical portion. This vertical portion of the cloth run is designated by x—x.

Figure 2:
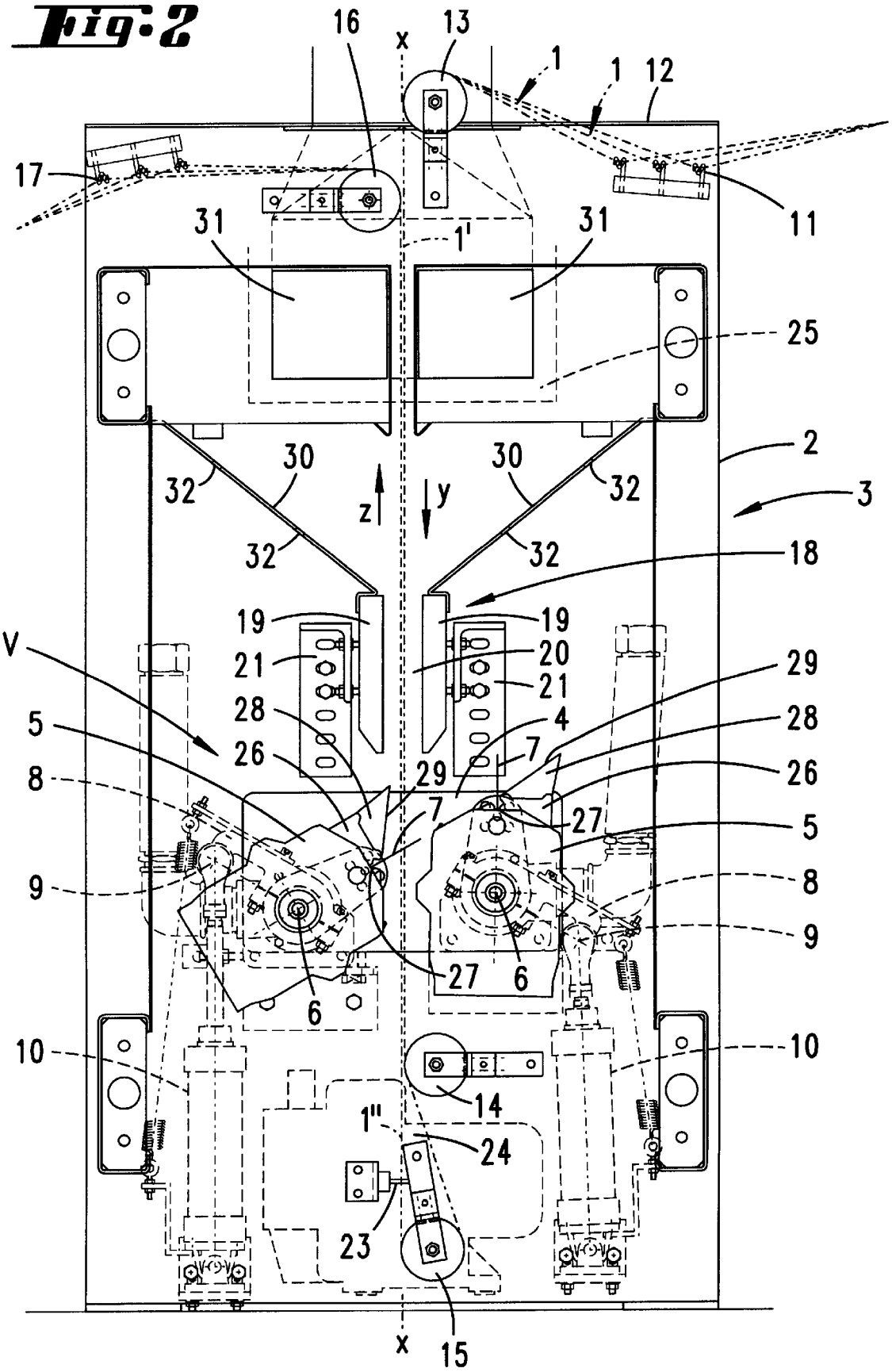
FIG. 2 shows the same front view, but with a free view into the interior of the apparatus.
Figure 3:
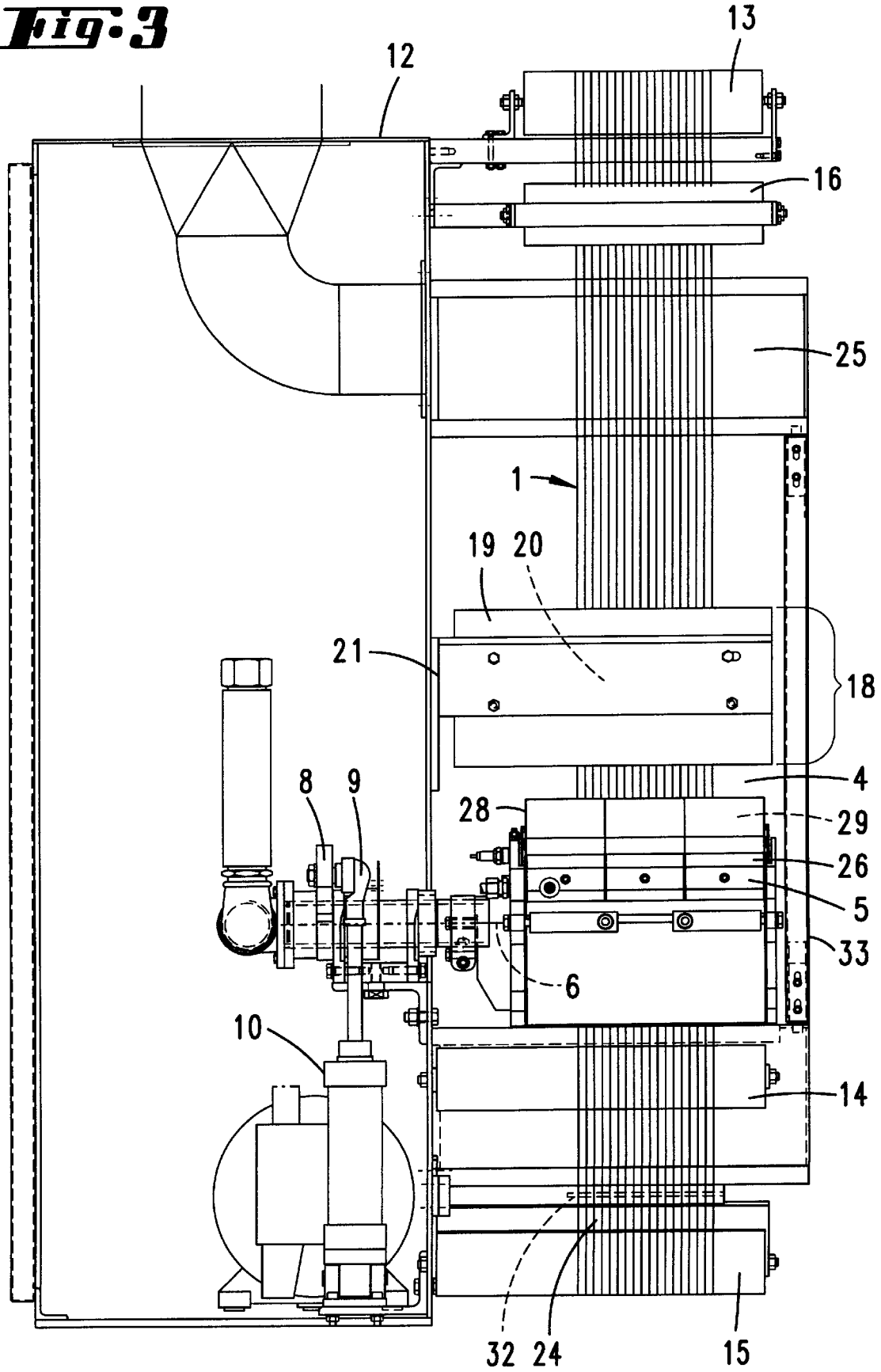
FIG. 3 shows a side view of the apparatus.
Figure 4:
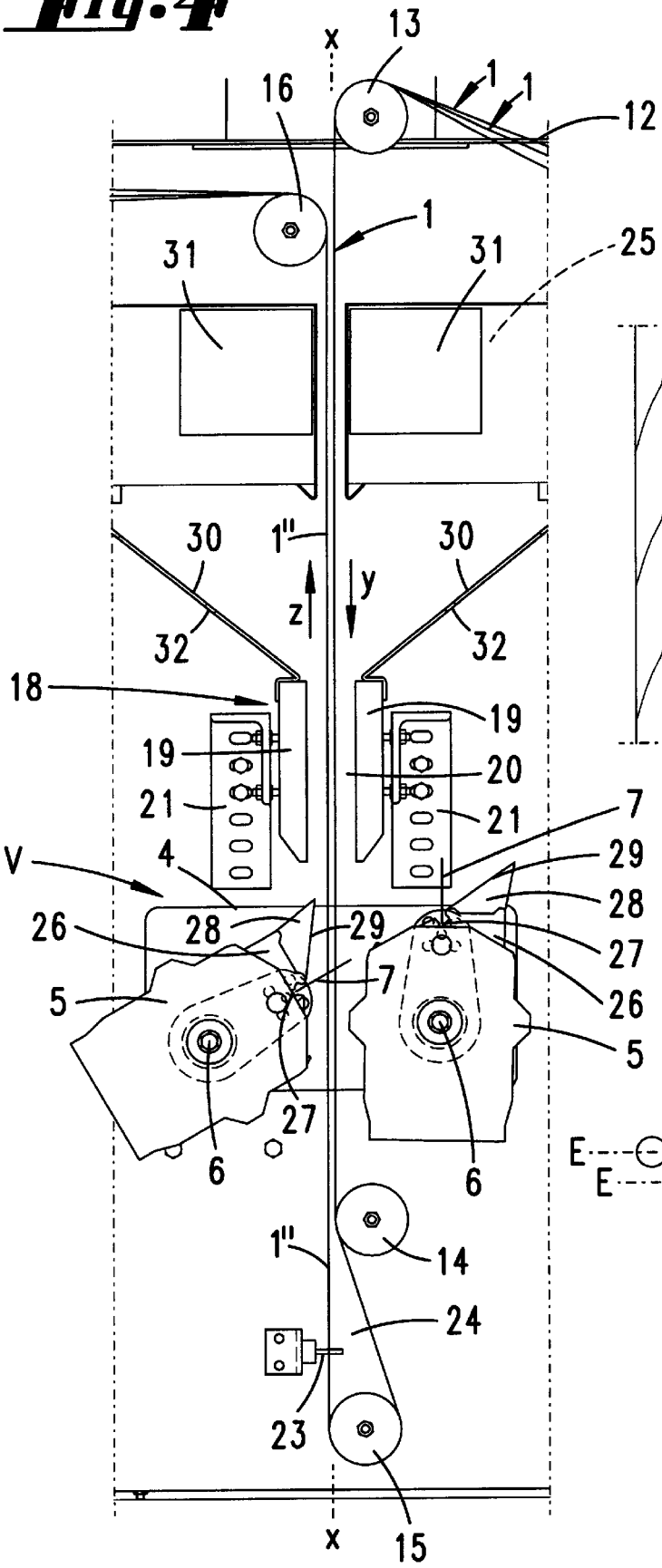
FIG. 4 shows an illustration of a detail of the latter.
Figure 5:
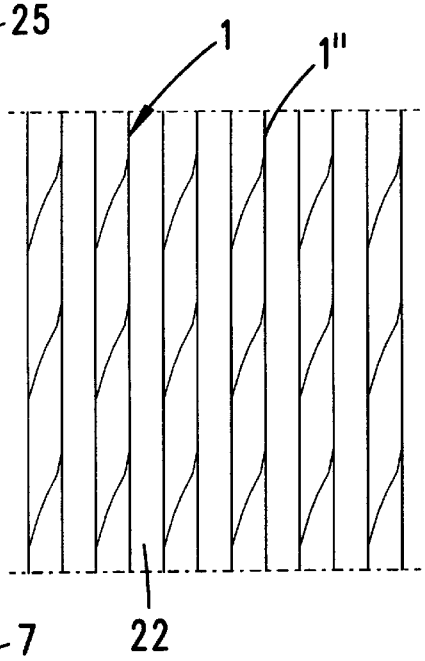
FIG. 5 shows a view toward a thread assembly.

The singeing flame, designated by 7, can be set at right angles to the cloth run or else be directed continuously upward, as emerges from the illustration on the right in FIG. 2. The pivot axes 6 lie at different heights. This purpose can be served by adjusting means, not illustrated, which may also be designed for varying the distance between the burners 5. A pivoting means allowing the burners 5 to be tilted is illustrated in rough outline. It comprises a pivoting arm 8 as a control member. Said pivoting arm is connected via an articulation point 9 to a working cylinder 10 itself. The working cylinder 10 is supported in an articulatedly movable manner near the bottom of the machine housing 2.

The conventional fuel gas feed lines and cooling lines are not illustrated, since these are customary items of equipment.

Contactless singeing (noncontact heat treatment by flame) takes place.

The thread assembly runs in from the gray cloth side through eyes 11. It passes from there, via an upper guide roller 13 located in the region of a ceiling 12 of the singeing machine 3, into the vertical portion x—x of the cloth run. This running-to thread 1' of a running-to thread assembly arrives at a lower guide roller 14 arranged near the bottom of the singeing machine 3.

A deflecting roller 15 is located below the lower guide roller 14. This deflecting roller forms, with respect to the freely guided cloth, a reversal point in the form of a U-turn. From here, the thread 1 or the thread assembly runs back in the direction of the ceiling 12 of the singeing machine 3. This running-back thread of the thread assembly bears the reference symbol 1". The opposite run is free of any contact with respect to the threads 1', 1" passing one another in parallel. The running-back thread 1" of the thread assembly goes over a second upper guide roller 16. From here, the finished product is led further, once again eye-guided. These eyes bear the reference symbol 17. All the rollers 13–16 have their axes oriented essentially horizontally.

A heat section 18 extends above the burning zone 4 which forms the main part of a singeing machine 3. Said heat section is fed from the burning zone 4 located underneath it. The heat section 18 acts on the threads 1 solely by utilizing the energy of the singeing flame 7.

As can be seen, the threads 1 run through the heat section essentially centrally.

The thread 1, while passing through the heat section 18, undergoes thermosetting or heat setting. The effect on the plastic material is such that, as regards the macromolecular structure of the thread 1, a kind of lock curling effect occurs variably, for example over the transit time and the length of the heat section, as a result of a corresponding response temperature. While fiber movability and high elasticity or flexibility are preserved, the twist coils are fixed and there is a correspondingly strong return action on the thread. This property is useful particularly in the field of carpet manufacture. Pile naps or loop pile spring up. The twisting provides a welcome force accumulator. At the same time, the temperature is set in such a way that the fibers of the threads do not bond together. Instead, the cloth has good affinity or better dye absorption.

Furthermore, care is taken to ensure that the thread 1, which receives a thermosetting in an essentially relaxed state, has a uniformly moderate tensile stress. The appropriately moderate tensile stress can be achieved by the use of an own drive of at least part of the guide rollers 13 or 14 or 16 and/or of the deflecting roller 15.

The roller configuration illustrated results, with respect to the freely guided cloth, in pretreatment involving thermosetting and in such an aftertreatment. This is because the threads 1 pass through the heat section 18 in the vertical portion x—x of the cloth run both in the direction (arrow y) running toward the burner 5 and in the direction (arrow z) running back from the burner 5. The U-guidance of the thread 1 allows this efficient double passage. Depending on the gray cloth used, multiple U-deflection may also be employed.

The heat section 18, designed virtually in the manner of a tunnel, is in the form of a plate-like body 19. This is assigned as a pair. The two bodies bear the reference symbol 19. According to the illustration in the drawing, they leave between them a gap 20 oriented parallel to the path of the thread 1' running to and of the thread 1" running back. There is a clearance between the underside of the bodies 19 forming the gap 20 and the burner or burners 5. Said clearance leaves lateral slotlike orifices as air passages into the burning zone 4 and, further, into the heat flow.

The plate-like bodies 19 can be heated passively. They consist of ceramic material.

The plate-like bodies 19 can be adjusted in the direction of the path of the threads 1, that is to say vertically, but also transversely thereto, that is to say horizontally. The clear width of the chimneylike gap 20 can be fixed in this way.

As may also be inferred from the drawing, the plate-like bodies 19 taper in the direction of the burning zone 4 located underneath them. The taper originates from the back of the plate-like bodies 19 and is approximately 60°.

Horizontally running anchor bolts project from the back of the plate-like bodies 19. Said bolts pass through a vertical leg of a bracket 21. Said leg has vertical slots, through which the anchor bolts pass and to which they can be clamped. For example, lock nuts serve this purpose. For horizontal adjustment, there are measures which make it possible, for example, to adjust the brackets 21. Said measures are correspondingly oriented long holes. Clamp-fastening screws pass through these.

For adjustment purposes, a minimum distance between the plate-like bodies 19 is defined, which ensures that the threads 1, both those running to and those running back 1', 1", pass through the heat section 18, without touching the front sides of the plate-like bodies 19. Contactless thread guidance takes place. In this case, the thread 1' running to runs counter to the essentially upwardly pointing flame direction and the other thread 1" runs in the same direction as the latter.

On the other hand, it is possible to achieve a width of the gap 20 which ensures that the singeing flame 7 of the burner or burners 5 strikes that surface of the heatable bodies 19 which faces the threads 1.

Figure 6:
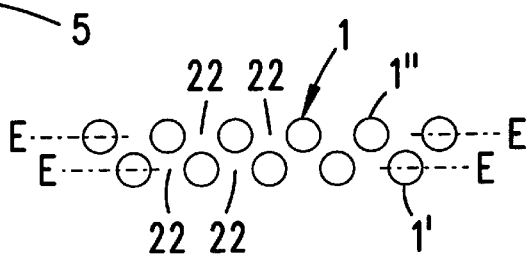
FIG. 6 shows a cross section through a double-ply thread assembly running at ordered intervals.

The threads 1 of the respective thread assembly are spaced from one another with respect to a linear thread assembly plane E—E. They run parallel, with a gap 22 being left between them in each case. The same applies to the adjacent thread assembly, the likewise linear thread assembly plane of which is also designated by E—E. These threads 1, too, are at an equal parallel distance from one another, likewise leaving a gap 22. Reference is made, in this respect, to the illustration in FIG. 6. Referring also the illustration in FIG. 2, it can then easily be seen that the threads 1', 1" running to and back are also racked to one another, transversely to the thread assembly plane E—E, in the region of the heat section 18. The arrangement achieved in this way, which resembles an offset grid-and in which the gaps 22 have a width which corresponds to the diameter of the thread located in front of the gap 22, allows the heat flow to have access on all sides to the article to be singed so that it, as it were, sweeps round the latter. The center axes of the threads may lie (are imagined as lying) at the corners of an equilateral triangle.

This thread arrangement is achieved by means of a racking comb 23. Its teeth mesh with the running-back threads 1" of the thread assembly. Said racking comb 23 is located near the bottom of the machine housing 2, specifically in a vertical clearance region 24 between the lower guide roller 14 and the deflecting roller 15 arranged below the latter. In this clearance region 24, the thread portion deviating downstream of the lower guide roller 14 projects freely from the corresponding portion of the running-back thread 1" as a result of looping around the deflecting roller 15. The running contour of the guided cloth is wedgelike, so that the tines of the racking comb 23 do not penetrate into the region of the thread 1' running to.

In order to vary the racking of the thread assembly which comes and goes, the racking comb 23 is adjustable horizontally and is lockable. The outer surfaces of the rollers may be finely scored peripherally. It would also be possible by this means, to achieve racking control of the thread assembly, for example via the deflecting roller 15.

Figure 9:
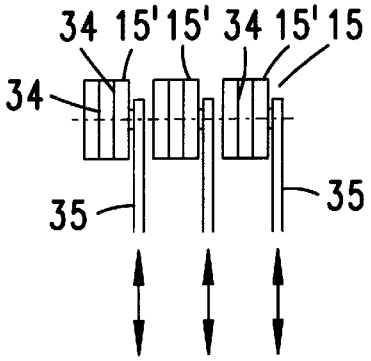
FIG. 9 shows an illustration corresponding to that of FIG. 8, the deflecting roller consisting of a plurality of individual rollers actuable independently of one another.
Figure 9:
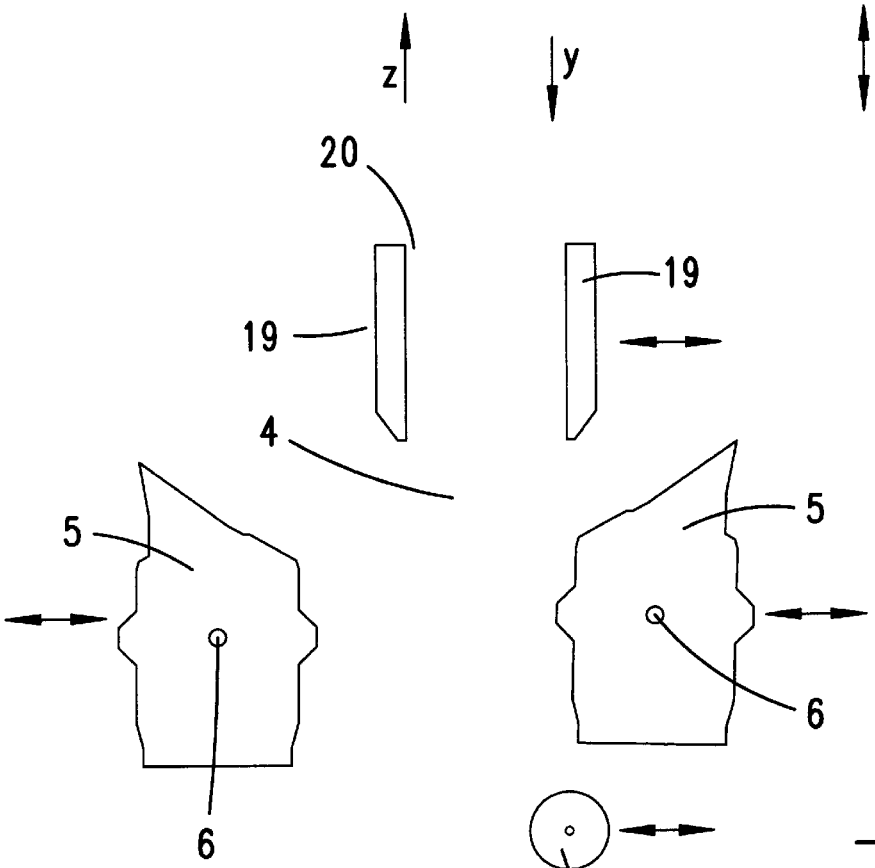
Figure 8:
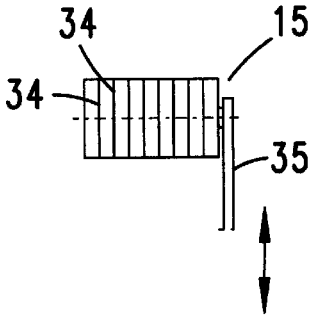
FIG. 8 shows a side view of the lift-displaceable deflecting roller used in this case.
Figure 8:
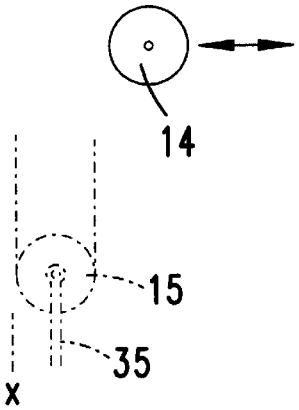

The racking control of the thread 1 or of the thread assembly may also be achieved via guide grooves 34 of the deflecting roller 15. Such guide grooves 34 are illustrated in FIGS. 8 and 9.

Figure 7:
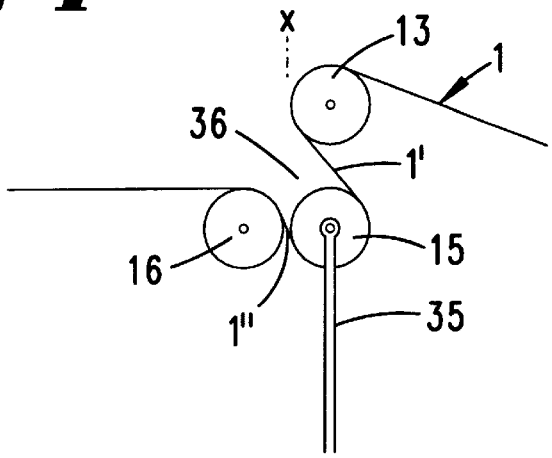
FIG. 7 shows an illustration of a detail, corresponding to that of FIG. 4, but more diagrammatically, specifically a development in the form of an introduction aid for introducing the thread into the apparatus.

The deflecting roller 15 not only per-forms the turn effect, but also a further function. According to the variant in FIG. 7, it is developed into a threading-in device. Specifically, the deflecting roller 15 functions, there, as an introduction aid which brings the thread 1 to the appropriate location. In other words, it draws the thread 1, grasped on the entry side outside the heat section and the burning zone 4, abruptly into these regions 18 and 4 in the vertical direction. This may take place via a windable pull rope counter to the return force of a restoring spring of a slide-guided mounting of the deflecting roller.

In order to bring about this vertically directed displacement of the deflecting roller 15, however, the latter is mounted on the free end of a correspondingly vertically acting lifting arrangement 35, as illustrated. This may be a telescopic arrangement with a corresponding working cylinder (the latter not being illustrated). On the other hand, however, as indicated above, the deflecting roller 15 may also be displaced in a vertical rail guide of the singeing machine 3. In order to receive the turn-forming portion of the thread 1, the deflecting roller is moved to just below the upper guide roller 13. The lower guide roller 14, which in this case stands in the way, is moved out of the way to the right and, after the return of the deflecting roller 15, is guided back again into its position near the base. The takeover of the thread 1 from the region of the ceiling 12 is best achieved by this means, so that the deflecting roller 15 can be lowered from the thread receiving point 36 located near the feed and removal point into the singeing/thermosetting operating position. The right-hand plate-like body 19 and the right-hand burner 5 located below the latter are likewise briefly displaced out of the way. A horizontally oriented working cylinder may be used in respect of the plate-like body. As regards the burner 5, displacement takes place, for example or expediently, in the way described in German Utility Model 295 05 376 mentioned. These details will not be discussed any further here.

The feed and removal points of the thread 1 are formed by the upper guide rollers 13 and 16.

In the variant according to FIG. 9, the deflecting roller 15 of the introduction aid consists of a plurality of individual rollers 15'. Each of these individual rollers 15' of the deflecting roller is actuable via a separately acting lifting arrangement 35. Each individual roller 15' may have one or more grooves 34 in the circumferential direction for thread guidance.

A suction chamber 25 is located in the vicinity of the ceiling 12 of the singeing machine 3. This suction chamber 25, arranged upstream of the heat section 18 in the run-to direction of the threads 1, functions as an exhauster. For this purpose, it has an offtake fan (not illustrated). The exhauster, inter alia, discharges, above all, fuel dust. Moreover, by means of a permanently generated air draft of the offtake fan, the singeing flame 7, set more or less in the upward direction, or the heat flow of the burners 5 is sucked into the region of the heat section 18. The exhauster thus performs a double function.

The burners 5 also have a flow-conducting action. Their face is flush with the so-called rail block 26. The latter forms a singeing slot 27. The face of this rail block 26 is beveled with respect to the singeing slot 27 determining the flame direction (cf. the straight line indicating the singeing flame 7). This is so that a wedgelike freely projecting hornlike contour, as a portion 28, is obtained on the far side of the singeing slot 27, that is to say facing away from the vertical portion x—x of the cloth run. The portion 28 functions, with its surface facing the threads 1, as a kind of guide plate. The acute angle formed with the exit direction of the singeing slot 27 is between 40° and 60°, but preferably around 45°. The orientation which can be achieved is, however, such that, starting from flaming at right angles, that is to say perpendicularly to the vertical cloth run, an acute angle of approximately 15° of the singeing flame 7 is obtained, and consequently a singeing flame which is more tangential. The position of the burner 5, said position being shown on the left in FIG. 2, is such that the flame-guiding or flame-leading surface decreases on the end face in relation to the plane of the portion x—x. In terms of width, the taper is still within the clear distance between the bodies 19 defining the gap 20. This results even in the possibility of direct flame introduction, assisted in its flow by the suction chamber 25 described. The freely projecting portion 28 has a triangular contour. The opposite portion of the rail block 26, said portion being located on the other side of the singeing slot 27, is set back correspondingly. This portion, despite being in close proximity to the thread assembly 1, is therefore not in the way.

A stamped-out portion of the suction chamber 25, said portion resembling a V-shaped trough, serves for the further controlled conduction of the heat flow above the heat section 18. As can be seen, bottom walls 30 diverging in the direction of the suction chamber 25 are produced there. Said walls adjoin the heads of the plate-like bodies 19 in the manner of a seat and, at the end, go as far as the edge of the suction chamber 25. The latter has both air inlet apertures 31 located laterally in the upper region and air inlet slots 32 located in the bottom walls 30. The bottom walls 30 both have the same slope and form an angle of approximately 100°. The rear side of the suction chamber 25, tapering at an angle on the bottom side, is closed by means of a vertical housing wall; the front side is kept shut via wing doors 33 which extend at least over the downwardly tapering region.

BRIEF SUMMARY

The singeing apparatus V, produced, for example, as a double-jet high-performance singeing burner, operates with a continuous flame band and uses a gas/air mixture. In this case, within the singeing apparatus V, in addition to the singeing, and at the same time as the singeing, but at a different location, the thread 1 is thermoset, in the heat section 18 located above the burning zone 4, as a result of the macromolecular action achieved thereby. This takes place primarily during the run-to and subsequently during the runback, that is to say when singeing is completed, specifically in a heat zone which is therefore put to double use. The threads 1 are run at a speed of 500 to 1500 m/min. At this speed, the threads 1 pass both through the active singeing flame 7, penetrating the assembly, and through said heat section 18.

The temperature of the singeing flame 7 is approximately 1200° C. and that of the heat section 18 is around 400–500° C. However, the quality of the cloth, the length of the plate-like bodies 19 and the dwell time in the shaft 20 are decisive factors.

What is claimed is:

1. An apparatus (V) for the singeing of threads (1) of a thread assembly, the thread assembly comprising twisted threads of a plastic material, said apparatus (V) comprising a heat section (18), and a burner (5) which produces a singeing flame (7);

wherein the threads (1) run, upstream and/or downstream of the singeing flame (7), through said heat section (18), said heat section being formed independently of the burner (5); and the heat section comprises at least one platelike heatable body (19) extending in the direction of the threads and being located relative to the burner at a position for receiving heat from the burner, said position of the platelike heatable body being adjustable in at least one of a direction transverse to a run of the threads and a direction parallel to the run of the threads to establish an operating temperature of heat radiated by the platelike heatable body to the threads, the platelike heatable body being set at a temperature influencing a macromolecular structure of the plastic material.

2. The apparatus as claimed in claim 1, wherein the heat section (18) acts on the threads (1) by utilizing the energy of the singeing flame (7).

3. The apparatus as claimed in claim 1, wherein two platelike bodies (19) are arranged opposite one another so as to form a gap (20).

4. The apparatus as claimed in claim 1, wherein the threads (1) run past the platelike body (19), without touching it.

5. The apparatus as claimed in claim 1, wherein the platelike body (19) comprises a ceramic material.

6. The apparatus as claimed in claim 1, wherein the singeing flame (7) of the burner (5) strikes a surface of the heatable body (19) which surface faces the threads (1).

7. The apparatus as claimed in claim 1, wherein burners (5) are arranged on both sides of a run of the thread assembly.

8. The apparatus as claimed in claim 1, wherein the heatable body (19) is adjustable in the direction of the run of the threads (1).

9. The apparatus as claimed in claim 1, wherein the threads (1) pass through the singeing flame (7) and the heat section (18) at a speed of 500–1500 m/min.

10. The apparatus as claimed in claim 1, wherein a temperature of the singeing flame (7) of the burner is approximately 1200° C. and the temperature of the heat section is approximately 400–500° C.

11. An apparatus (V) for the singeing of threads (1) of a thread assembly, the thread assembly comprising twisted threads of a plastic material, said apparatus (V) comprising a heat section (18), and a burner (5) which produces a singeing flame (7), wherein the threads (1) run, upstream and/or downstream of the singeing flame (7), through said heat section, said heat section being formed independently of the burner (5) and being set at a temperature influencing a macromolecular structure of the plastic material;

the heat section comprises at least one platelike heatable body (19) extending in the direction of the threads; and the heatable body (19) is adjustable in a transverse direction to a run of the threads (1).

12. An apparatus (V) for the singeing of threads (1) of a thread assembly, the thread assembly comprising twisted threads of a plastic material, said apparatus (V) comprising a heat section (18), and a burner (5) which produces a singeing flame (7), wherein the threads (1) run, upstream and/or downstream of the singeing flame (7), through said heat section, said heat section being formed independently of the burner (5) and being set at a temperature influencing a macromolecular structure of the plastic material;

the heat section comprises a plurality of platelike heatable bodies (19) extending in the direction of the threads; and treatment of the threads (1) over the length of the bodies (19) and a speed of action are variable.

13. An apparatus (V) for the singeing of threads (1) of a thread assembly, the thread assembly comprising twisted threads of a plastic material, said apparatus (V) comprising a heat section (18), and a burner (5) which produces a singeing flame (7), wherein the threads (1) run, upstream and/or downstream of the singeing flame (7), through said heat section, said heat section being formed independently of the burner (5) and being set at a temperature influencing a macromolecular structure of the plastic material; and the threads (1) are guided twice through said heat section (18).

14. An apparatus (V) for the singeing of threads (1) of a thread assembly, the thread assembly comprising twisted threads of a plastic material, said apparatus (V) comprising a heat section (18), and a burner (5) which produces a singeing flame (7), wherein the threads (1) run, upstream and/or downstream of the singeing flame (7), through said heat section, said heat section being formed independently of the burner (5) and being set at a temperature influencing a macromolecular structure of the plastic material; and the threads (1) are guided several times through the heat section (18).

15. An apparatus (V) for the singeing of threads (1) of a thread assembly, the thread assembly comprising twisted threads of a elastic material, said apparatus (V) comprising a heat section (18), and a burner (5) which produces a singeing flame (7), wherein the threads (1) run, upstream and/or downstream of the singeing flame (7), through said heat section, said heat section being formed independently of the burner (5) and being set at a temperature influencing a macromolecular structure of the plastic material; and the threads (1) pass through the heat section (18) both in a direction (arrow y) running toward the burner (5) and in a direction (arrow z) running back from the burner (5).

16. An apparatus (V) for the singeing of threads (1) of a thread assembly, the thread assembly comprising twisted threads of a plastic material, said apparatus (V) comprising a heat section (18), and a burner (5) which produces a singeing flame (7), wherein the threads (1) run, upstream and/or downstream of the singeing flame (7), through said heat section, said heat section being formed independently of the burner (5) and being set at a temperature influencing a macromolecular structure of the plastic material; and the threads (1', 1") running to and running back are racked relative to one another, transversely to a plane of the thread assembly (E—E), in a region of the heat section (18).

17. An apparatus (V) for the singeing of threads (1) of a thread assembly, the thread assembly comprising twisted threads of a plastic material, said apparatus (V) comprising a heat section (18), and a burner (5) which produces a singeing flame (7), wherein the threads (1) run, upstream and/or downstream of the singeing flame (7), through said heat section, said heat section being formed independently of the burner (5) and being set at a temperature influencing a macromolecular structure of the plastic material; and the threads (1, 1") running to and running back are racked relative to one another, in a plane of the thread assembly (E—E), in a region of the heat section (18).

18. An apparatus (V) for the singeing of threads (1) of a thread assembly, the thread assembly comprising twisted threads of a plastic material, said apparatus (V) comprising a heat section (18), and a burner (5) which produces a singeing flame (7), wherein the threads (1) run, upstream and/or downstream of the singeing flame (7), through said heat section, said heat section being formed independently of the burner (5) and being set at a temperature influencing a macromolecular structure of the plastic material; and the burner (5) has a rail block (26) forming a singeing slot (27), wherein in a working position of the burner (5), the rail block (26) has a surface (29) facing the threads (1) and said surface forms an acute angle with the singeing slot (27).

19. The apparatus as claimed in claim 18, wherein the rail block (26) has a triangular contour, of which a portion (28) extends transversely to a plane of the thread assembly.

20. An apparatus (V) for the singeing of threads (1) of a thread assembly, the thread assembly comprising twisted threads of a plastic material, said apparatus (V) comprising a heat section (18), and a burner (5) which produces a singeing flame (7), wherein the threads (1) run, upstream and/or downstream of the singeing flame (7), through said heat section, said heat section being formed independently of the burner (5) and being set at a temperature influencing a macromolecular structure of the plastic material; and further comprising a suction chamber (25) with an offtake fan arranged upstream of the heat section (18) in a run direction (arrow y) of the threads (1).

21. The apparatus as claimed in claim 20, wherein the singeing flame (7) is sucked into a region of the heat section (18) by an air draft of the offtake fan.

22. The apparatus as claimed in claim 20, wherein the suction chamber (25) faces in a direction away from the heat section (18), and is provided with bottom walls (30) diverging in this direction.

23. The apparatus as claimed in claim 22, wherein the bottom walls (30) have air inlet slots (32).

24. An apparatus (V) for the singeing of threads (1) of a thread assembly, the thread assembly comprising twisted threads of a plastic material, said apparatus (V) comprising a heat section (18), and a burner (5) which produces a singeing flame (7), wherein the threads (1) run, upstream and/or downstream of the singeing flame (7), through said heat section, said heat section being formed independently of the burner (S) and being set at a temperature influencing a macromolecular structure of the plastic material; and further comprising a deflecting roller (15), as a guide roller, provided downstream of the burner (5) in a run-to direction (arrow y) of the threads (1).

25. The apparatus as claimed in claim 24, wherein the deflecting roller (15) is formed as an introduction aid bringing the thread (1) to an appropriate location.

26. The apparatus as claimed in claim 24, further comprising a lifting arrangement having a free end, and wherein the deflecting roller (15) is mounted on the free end of said lifting arrangement (35) displacing said deflecting roller from a thread receiving point (36) located near a feed and removal point into a singeing/thermosetting operating position.

27. The apparatus as claimed in claim 26, further comprising upper guide rollers, wherein the feed and removal points are formed by said upper guide rollers (13 and 16).

28. The apparatus as claimed in claim 24, further comprising a racking comb (23) arranged downstream of the deflecting roller (15).

29. The apparatus as claimed in claim 24, wherein the deflecting roller (15) has guide grooves (34).

30. The apparatus as claimed in claim 24, wherein the deflecting roller (15) comprises a plurality of individual rollers (15').

31. The apparatus as claimed in claim 30, wherein each said individual roller (15') of the deflecting roller is actuable via a separately acting lifting arrangement (35).

32. The apparatus as claimed in claim 27, further comprising self drive of at least part of the rollers determining the thread running direction, such as the guide rollers (13 or 14 or 16) and deflecting roller (15).

33. A method for the singeing of threads (1) of a thread assembly, the thread assembly comprising twisted threads (1) made of a plastic material, in an apparatus (V) having a burner (5) which produces a singeing flame (7), comprising the steps of:

singeing the threads within the apparatus (V);

locating a heat section to be heated by the burner, wherein the heat section comprises at least one platelike heatable body (19) extending in the direction of the threads and being located relative to the burner at a position for receiving heat from the burner, said position of the platelike heatable body being adjustable in at least one of a direction transverse to a run of the threads and a direction parallel to the run of the threads to establish an operating temperature of heat radiated by the platelike heatable body to the threads, the platelike heatable body; and running the threads past the heat section to establish macromolecular action on the threads (1).

* * * * *